US011648552B2

(12) United States Patent
Zhang et al.

(10) Patent No.: US 11,648,552 B2
(45) Date of Patent: May 16, 2023

(54) MICROFLUIDIC DEVICE, DRIVING METHOD THEREOF, AND MICROFLUIDIC SYSTEM

(71) Applicant: BOE TECHNOLOGY GROUP CO., LTD., Beijing (CN)

(72) Inventors: Ping Zhang, Beijing (CN); Haisheng Wang, Beijing (CN); Xiaoliang Ding, Beijing (CN); Wei Liu, Beijing (CN); Xueyou Cao, Beijing (CN); Pengpeng Wang, Beijing (CN); Yanling Han, Beijing (CN); Jiabin Wang, Beijing (CN); Yangbing Li, Beijing (CN); ChihJen Cheng, Beijing (CN); Likai Deng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 1108 days.

(21) Appl. No.: 16/291,503

(22) Filed: Mar. 4, 2019

(65) Prior Publication Data

US 2019/0366332 A1 Dec. 5, 2019

(30) Foreign Application Priority Data

May 29, 2018 (CN) ..... 201810529880.X

(51) Int. Cl.
*B01L 3/00* (2006.01)

(52) U.S. Cl.
CPC ... *B01L 3/50273* (2013.01); *B01L 2300/0645* (2013.01); *B01L 2300/0887* (2013.01); *B01L 2300/165* (2013.01); *B01L 2400/0439* (2013.01)

(58) Field of Classification Search
CPC ..... B01L 3/50273; B01L 2300/0645; B01L 2300/0887; B01L 2300/165;
(Continued)

(56) References Cited

U.S. PATENT DOCUMENTS

2006/0078473 A1 4/2006 Murakami
2009/0254289 A1 10/2009 Vivek et al.

FOREIGN PATENT DOCUMENTS

CN 101360566 A 2/2009
CN 104084249 A 10/2014
(Continued)

OTHER PUBLICATIONS

First Office Action dated Jun. 15, 2020, for corresponding Chinese application 201810529880.X.
(Continued)

*Primary Examiner* — Samuel P Siefke
(74) *Attorney, Agent, or Firm* — Nath, Goldberg & Meyer; Joshua B. Goldberg

(57) ABSTRACT

The present disclosure provides a microfluidic device, a driving method thereof and a microfluidic system. The microfluidic device includes a first substrate and a second substrate disposed opposite to each other, and a microcavity provided between the first and second substrates for accommodating droplets. The microfluidic device further includes at least one ultrasonic layer provided between the first and second substrates. The at least one ultrasonic layer includes a plurality of ultrasonic sensors configured to perform at least one of detection operation and driving operation to the droplets accommodated in the microcavity.

15 Claims, 6 Drawing Sheets

(58) Field of Classification Search
CPC ..... B01L 2400/0439; B01L 3/502792; B01L 2200/0673; B01L 2300/0816; B01L 3/5027; B01L 2200/10; B01L 2300/0861
See application file for complete search history.

(56) References Cited

FOREIGN PATENT DOCUMENTS

| | | | |
|---|---|---|---|
| CN | 105214742 | A | 1/2016 |
| CN | 107583694 | A | 1/2018 |
| CN | 107607475 | A | 1/2018 |
| CN | 107736900 | A | 2/2018 |

OTHER PUBLICATIONS

The Second Office Action dated Apr. 2, 2021 corresponding to Chinese application No. 201810529880.X.

MICROFLUIDIC DEVICE, DRIVING METHOD THEREOF, AND MICROFLUIDIC SYSTEM

TECHNICAL FIELD

The present disclosure relates to the technical field of microfluidics, and particularly relates to a microfluidic device, a driving method thereof, and a microfluidic system.

BACKGROUND

Microfluidic systems have many applications in control and detection of tiny droplets (hereinafter referred to as droplets) in chemical and medical fields.

A current droplet driving method mainly includes providing a droplet between an upper electrode and a lower electrode, and applying voltages to the upper and lower electrodes to generate an electric field, so as to drive the droplet to move. However, such driving method requires that the droplet must contain ions so as to be driven in response to the electric field. Furthermore, from the point of view of detection, droplet detection methods mainly include a capacitive detection method and an optical detection method, which will lead to complex structures of microfluidic devices.

SUMMARY

The present disclosure is directed to solve at least one of the technical problems found in related art, and provides a microfluidic device, a driving method thereof and a microfluidic system, which may remove restriction that droplets must contain ions and simplify device structures.

One aspect of the present disclosure provides a microfluidic device, including a first substrate and a second substrate disposed opposite to each other, and a microcavity provided between the first and second substrates for accommodating droplets. The microfluidic device further includes at least one ultrasonic layer provided between the first and second substrates, wherein the at least one ultrasonic layer includes a plurality of ultrasonic sensors configured to perform at least one of detection operation and driving operation to the droplets accommodated in the microcavity.

According to embodiments of the present disclosure, at least one ultrasonic layer is provided between the first substrate and the microcavity, and/or at least one ultrasonic layer is provided between the second substrate and the microcavity.

According to the embodiments of the present disclosure, two ultrasonic layers are provided between the first substrate and the microcavity, or between the second substrate and the microcavity, an orthographic projection of each ultrasonic sensor in one of the two ultrasonic layers on the first substrate does not completely overlap an orthographic projection of each ultrasonic sensor in the other one of the two ultrasonic layers on the first substrate, and each ultrasonic sensor in one of the two ultrasonic layers is configured to detect the droplets accommodated in the microcavity, and each ultrasonic sensor in the other one of the two ultrasonic layers is configured to drive the droplets accommodated in the microcavity.

According to the embodiments of the present disclosure, the ultrasonic sensors in the two ultrasonic layers differ in volume.

According to the embodiments of the present disclosure, one ultrasonic layer is provided between the first substrate and the microcavity, and one ultrasonic layer is provided between the second substrate and the microcavity, wherein an arrangement density of the plurality of ultrasonic sensors in the ultrasonic layer between the first substrate and the microcavity is different from that of the plurality of ultrasonic sensors in the ultrasonic layer between the second substrate and the microcavity.

According to the embodiments of the present disclosure, the plurality of ultrasonic sensors in the ultrasonic layer between the first substrate and the microcavity are arranged to be corresponding to intervals each between two adjacent ultrasonic sensors in the ultrasonic layer between the second substrate and the microcavity.

According to the embodiments of the present disclosure, the microfluidic device further includes two hydrophobic layers disposed opposite to each other and between the first and second substrates; and spacers provided between the two hydrophobic layers, wherein the microcavity is composed of the two hydrophobic layers and the spacers, and the at least one ultrasonic layer is positioned on a side of the hydrophobic layers away from the microcavity.

According to the embodiments of the present disclosure, the microcavity is provided therein with a filling medium having an acoustic impedance coefficient greater than or equal to that of the hydrophobic layers.

According to the embodiments of the present disclosure, each ultrasonic sensor includes a first electrode, a piezoelectric layer and a second electrode which are sequentially disposed along a direction away from the microcavity, wherein the first electrode and/or the second electrode have/has a block structure. The microfluidic device further includes a transistor layer including a plurality of thin film transistors and an insulation layer, wherein the thin film transistors are positioned on a side of the first substrate and/or the second substrate close to the microcavity, and the plurality of thin film transistors are provided to be corresponding to the plurality of ultrasonic sensors, the insulation layer is provided on the first substrate and/or the second substrate and covers the plurality of thin film transistors, wherein the second electrode is provided on a side of the insulation layer close to the microcavity, and is electrically connected with the thin film transistor through a via.

Another aspect of the present disclosure provides a microfluidic system, including the microfluidic device of the present disclosure, and a processing unit, wherein the processing unit is configured to drive the microfluidic device.

Another aspect of the present disclosure provides a driving method of a microfluidic device, the microfluidic device including a first substrate and a second substrate disposed opposite to each other, a microcavity provided between the first and second substrates for accommodating droplets, and at least one ultrasonic layer provided between the first and second substrates, wherein the at least one ultrasonic layer includes a plurality of ultrasonic sensors configured to perform at least one of detection operation and driving operation to the droplets accommodated in the microcavity, and the method includes determining a moving path of a droplet according to detection parameters obtained by detecting the droplet accommodated in the microcavity and a target position; and controlling the ultrasonic sensors to emit ultrasonic waves according to the moving path, so as to drive the droplet to move from a current position to the target position along the moving path.

According to the embodiments of the present disclosure, the step of controlling the ultrasonic sensors to emit ultrasonic waves according to the moving path so as to drive the droplet to move from the current position to the target position along the moving path includes selecting at least one ultrasonic sensor to transmit an ultrasonic driving signal to the microcavity according to the detection parameters and the 15 moving path of the droplet.

According to the embodiments of the present disclosure, by providing each ultrasonic sensor used to transmit the ultrasonic driving signal with different delay time, the ultrasonic driving signal transmitted by each ultrasonic sensor may generate a maximum surface sound pressure at a same designated position.

According to the embodiments of the present disclosure, the step of determining the moving path of the droplet according to the detection parameters and the target position includes transmitting an ultrasonic detection signal to the microcavity by the ultrasonic sensor, and determining the detection parameters of the droplet according to a magnitude of ultrasonic reflectivity of a feedback signal from the microcavity.

According to the embodiments of the present disclosure, the detection parameters include shape, size and current position of the droplet.

DETAILED DESCRIPTION

In order to enable those skilled in the art to better understand the technical solutions of the present disclosure, the microfluidic device, the driving method thereof, and the microfluidic system will be further described in detail below with reference to the accompanying drawings.

The present disclosure provides a microfluidic device, including a first substrate and a second substrate disposed opposite to each other, and a microcavity provided between the first and second substrates for accommodating a liquid to be detected. In a microscale environment formed in the microcavity, the liquid to be detected has unique fluid properties, that is, forming droplets or a liquid column extending for a certain distance. Micromachining and micro-operation, which are difficult to accomplish by a series of conventional methods, may be achieved by detecting and controlling the liquid.

Ultrasonic waves are a kind of mechanical waves, propagate in media in a form of vibrating mechanical waves, and produce sound pressure on surfaces of two types of media. The microfluidic device provided by the present disclosure may use sound pressure produced by enhanced ultrasonic waves as a driving force of the liquid, so as to drive the liquid to move.

Figure 1:
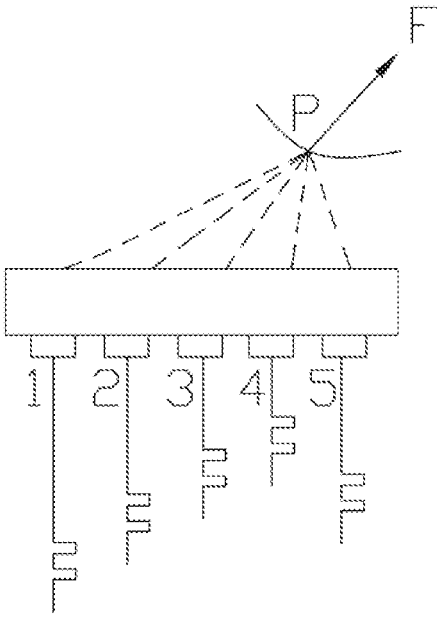
FIG. 1 is diagram showing a principle of application of ultrasonic sound pressure.

Specifically, as shown in FIG. 1, a principle of application of ultrasonic sound pressure is that ultrasonic sensors 1-5 located in different positions send driving signals which differ in delay time, so that ultrasonic waves emitted from the ultrasonic sensors 1-5 located in different positions differ in initial vibration time, which enables the driving signals to have an interference vibration strengthening effect while reaching a point P, so as to produce ultrasonic sound pressure F at the point P to drive a liquid (for example, droplets accommodated in the microcavity). By adjusting the delay time of the driving signals sent from the ultrasonic sensors located in different positions, a position of the ultrasonic vibration strengthening point P may be changed, so as to be capable of accurately driving a specified liquid.

Based on the above principle, the microfluidic device provided by the present disclosure includes at least one ultrasonic layer disposed between the first and second substrates, and the at least one ultrasonic layer includes a plurality of ultrasonic sensors configured to perform at least one of detection operation and driving operation to the droplets accommodated in the microcavity.

In other words, the droplets may be detected and driven by the at least one ultrasonic layer; or, the droplets may be driven by the at least one ultrasonic layer, and detected by other methods, such as a capacitive detection method and a photosensitive detection method; or, the droplets may be detected by the at least one ultrasonic layer, and driven by other methods, such as a voltage driving method.

Device structures may be simplified by using the ultrasonic sensors to detect the droplets. And restriction that the liquid must contains ions may be removed by using the ultrasonic sensors to drive the droplets.

It should be noted that detection parameters obtained by detecting the droplets may include shapes, sizes and current positions of the droplets.

According to embodiments of the present disclosure, at least one ultrasonic layer may be provided between the first substrate and the microcavity, and/or at least one ultrasonic layer may be provided between the second substrate and the microcavity. Specific implementations of the ultrasonic layer will be described below in detail.

Figure 2:
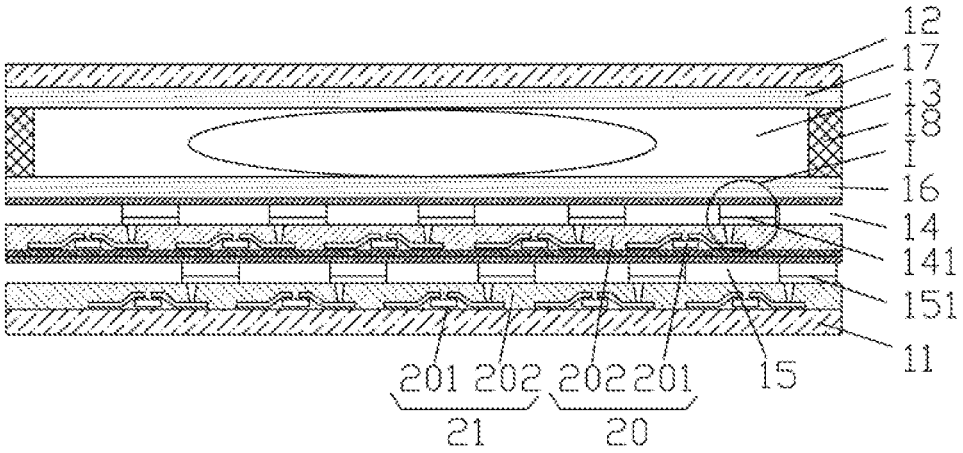
FIG. 2 is a sectional view of a microfluidic device according to embodiments of the present disclosure.

FIG. 2 is a sectional view of a microfluidic device according to the embodiments of the present disclosure.

As shown in FIG. 2, a microfluidic device provided by the present disclosure includes a first substrate 11 and a second substrate 12 disposed opposite to each other, and a microcavity 13 provided between the first substrate 11 and the second substrate 12. Two ultrasonic layers 14 and 15 are provided between the first substrate 11 and the microcavity 13, an orthographic projection of each ultrasonic sensor 141 in the first ultrasonic layer 14 on the first substrate 11 does not completely overlap an orthographic projection of each ultrasonic sensor 151 in the second ultrasonic layer 15 on the first substrate 11, for example, the orthographic projection of each ultrasonic sensor 141 in the first ultrasonic layer 14 on the first substrate 11 does not overlap the orthographic projection of each ultrasonic sensor 151 in the second ultrasonic layer 15 on the first substrate 11 at all, so as to ensure that signal occlusion does not happen to the two ultrasonic layers 14 and 15.

In the embodiment, orthographic projections of the plurality of ultrasonic sensors in each ultrasonic layer on the first substrate 11 or the second substrate 12 may be arranged in an array.

Each ultrasonic sensor 141 in the first ultrasonic layer 14 may be configured to detect the droplets, and each ultrasonic sensor 151 in the second ultrasonic layer 15 may be configured to drive the droplets. Alternately, each ultrasonic sensor 141 in the first ultrasonic layer 14 may be configured to drive the droplets, and each ultrasonic sensor 151 in the second ultrasonic layer 15 may be configured to detect the droplets.

In some embodiments of the present disclosure, the ultrasonic sensors in the two ultrasonic layers 14 and 15 differ in volume. Specifically, in order to enable the ultrasonic sensors configured to drive the droplets to produce a sufficient driving force, ultrasonic sensors in a larger volume may be adopted. The larger the ultrasonic sensor is, the greater the transmitting power is, so that the driving force may be increased. As for the ultrasonic sensors configured to detect the droplets, on the premise that normal detection is guaranteed, ultrasonic sensors in a smaller volume may be adopted, which allows increasing number and arrangement density of the ultrasonic sensors, so as to obtain higher detection resolution.

In the embodiment, the microfluidic device further includes two hydrophobic layers 16 and 17 disposed opposite to each other and between the first substrate 11 and the second substrate 12, and spacers 18 provided between the two hydrophobic layers 16 and 17. Actually, the microcavity 13 is composed of the two hydrophobic layers 16 and 17 and the spacers 18. Both of the two ultrasonic layers 14 and 15 are positioned on a side of the first hydrophobic layer 16 away from the microcavity 13.

The spacers 18 produce a supporting effect between the first substrate 11 and the second substrate 12, and form a closed cavity (i.e., the microcavity 13) together with the first substrate 11 and the second substrate 12, so as to prevent a liquid (for example, droplets) and/or a filling medium from leaking out.

Friction between the substrate and the liquid may be reduced by use of the hydrophobic layers, so that the liquid may be easily moved.

In the embodiment, the microcavity 13 is filled with a filling medium which has an acoustic impedance coefficient greater than or equal to that of the hydrophobic layers. In such a way, the filling medium may perform a function of acoustic impedance matching to decrease reflectivity of ultrasonic waves at a heterogeneous interface and increase ultrasonic transmittance, so as to make it easy for ultrasonic energy to transmit and act on surfaces of the droplets, thereby increasing acoustic emission efficiency.

Moreover, each functional layer of the ultrasonic sensor in the two ultrasonic layers 14 and 15 match the lower hydrophobic layer 16 in terms of acoustic impedance, so as to increase ultrasonic transmittance.

Figure 3:
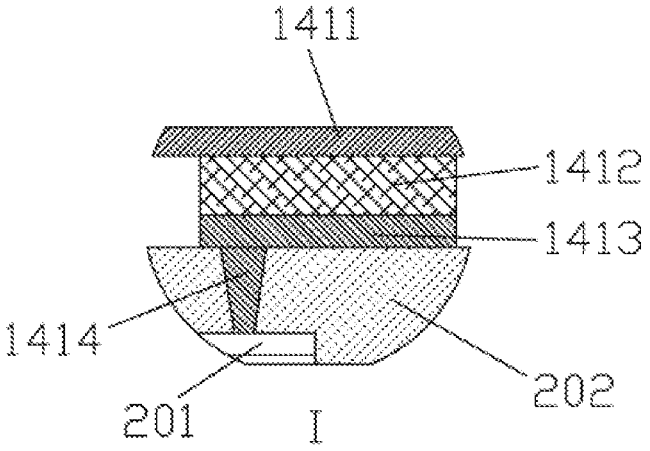
FIG. 3 is an enlarged view of area I in FIG. 2.
Figure 4A:
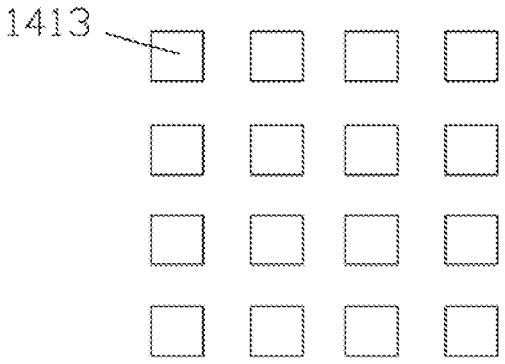
FIG. 4A is a schematic structural diagram of a second electrode of an ultrasonic sensor used in a microfluidic device according to embodiments of the present disclosure.
Figure 4B:
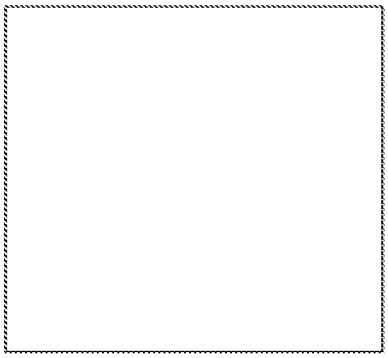
FIG. 4B is a schematic diagram of one structure of an electrode of an ultrasonic sensor used in a microfluidic device according to embodiments of the present disclosure.

In the embodiment, taking the ultrasonic sensors 141 as an example, as shown in FIG. 3, each ultrasonic sensor 141 includes a first electrode 1411, a piezoelectric layer 1412 and a second electrode 1413 sequentially disposed along a direction away from the microcavity 13. The first electrode 1411 has a full-surface structure without pattern as shown in FIG. 4B, and the second electrode 1413 has a block structure as shown in FIG. 4A, so that independent and accurate delay drive control may be performed to each ultrasonic sensor 141.

Figure 4C:
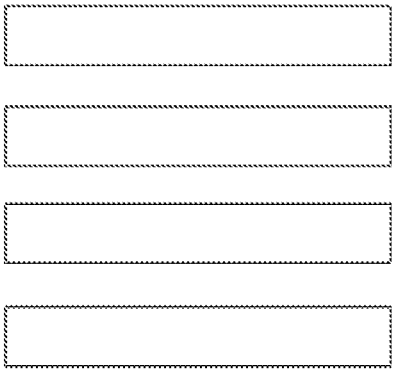
FIG. 4C is a schematic diagram of another structure of an electrode of an ultrasonic sensor used in a microfluidic device according to embodiments of the present disclosure.

In practical application, one of the first electrode 1411 and the second electrode 1413 (for example, the second electrode 1413) may have a block structure, while the other one (for example, the first electrode 1411) may have any structure other than a full-surface structure, such as a strip structure as shown in FIG. 4C.

With reference to FIG. 2, the microfluidic device may further include two transistor layers 20 and 21 provided on a side of the ultrasonic layer 14 away from the microcavity 13 and a side of the ultrasonic layer 15 away from the microcavity 13, respectively. Moreover, each of the transistor layers 20 and 21 includes a plurality of thin film transistors 201 and an insulation layer 202. Taking the transistor layer 20 as an example, the thin film transistors 201 are positioned on a side of the first substrate 11 close to the microcavity 13. The plurality of thin film transistors 201 are provided to be corresponding to the plurality of ultrasonic sensors 141 of the ultrasonic layer 14. The insulation layer 202 is provided on the first substrate 11 and covers the plurality of thin film transistors 201. With reference to FIG. 3, the second electrode 1413 is provided on a side of the insulation layer 202 close to the microcavity 13, and is electrically connected with the thin film transistor 201 through a via 1414. By use of the thin film transistors 201, independent and accurate delay drive control of each ultrasonic sensor may be realized.

It should be noted that two ultrasonic layers 14 and 15 are provided between the first substrate 11 and the microcavity 13 in the embodiment, but the present disclosure is not limited thereto. In practical application, two ultrasonic layers may be provided between the second substrate 12 and the microcavity 13.

Figure 5:
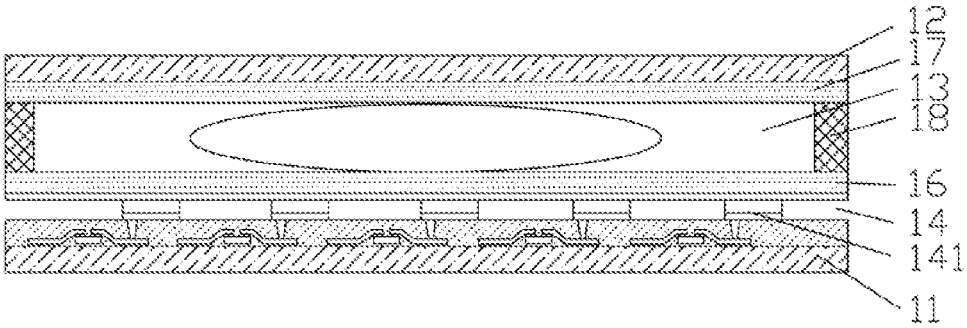
FIG. 5 is a sectional view of a microfluidic device according to another embodiment of the present disclosure.

FIG. 5 is a sectional view of a microfluidic device according to another embodiment of the present disclosure.

As shown in FIG. 5, the microfluidic device provided by the embodiment differs from that provided by the embodiment described with reference to FIG. 2 in that: only one ultrasonic layer 14 is provided between the first substrate 11 and the microcavity 13, which may also achieve detection operation and/or driving operation on the liquid.

Other structures of the microfluidic device provided by the embodiment are similar to that of the microfluidic device provided by the aforesaid embodiment, and thus will not be described in detail herein.

It should be noted that it is also feasible in practical application to provide only one ultrasonic layer between the second substrate 12 and the microcavity 13.

Figure 6A:
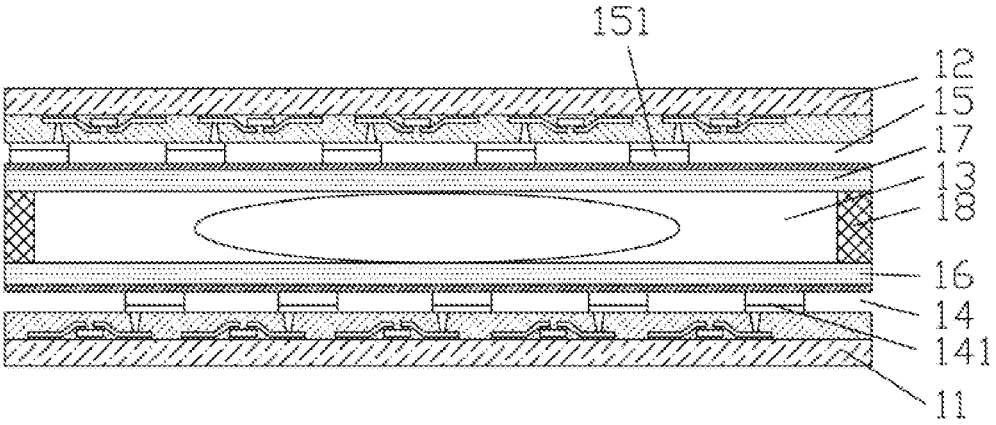
FIG. 6A is a sectional view of a microfluidic device according to yet another embodiment of the present disclosure.

FIG. 6A is a sectional view of a microfluidic device according to yet another embodiment of the present disclosure.

As shown in FIG. 6A, the microfluidic device provided by the embodiment differs from that provided by the embodiment described with reference to FIG. 2 in that: two ultrasonic layers 14 and 15 are provided on two sides of the microcavity 13, respectively, that is, the first ultrasonic layer 14 is provided between the first substrate 11 and the microcavity 13, and the second ultrasonic layer 15 is provided between the second substrate 12 and the microcavity 13.

In the embodiment, an arrangement density of the plurality of ultrasonic sensors 141 in the first ultrasonic layer 14 between the first substrate 11 and the microcavity 13 is different from that of the plurality of ultrasonic sensors 151 in the second ultrasonic layer 15 between the second substrate 12 and the microcavity 13. Since a resolution of the first ultrasonic layer 14 is different from that of the second ultrasonic layer 15, a synthetic resolution is a sum of the resolution of the first ultrasonic layer 14 and the resolution of the second ultrasonic layer 15, so that more accurate position information of the liquid may be acquired.

In some embodiments of the present disclosure, an orthographic projection of each ultrasonic sensor 141 in the first ultrasonic layer 14 on the first substrate 11 does not completely overlap an orthographic projection of each ultrasonic sensor 151 in the second ultrasonic layer 15 on the first substrate 11. For example, the orthographic projection of each ultrasonic sensor 141 in the first ultrasonic layer 14 on the first substrate 11 does not overlap the orthographic projection of each ultrasonic sensor 151 in the second ultrasonic layer 15 on the first substrate 11 at all.

Figure 6B:
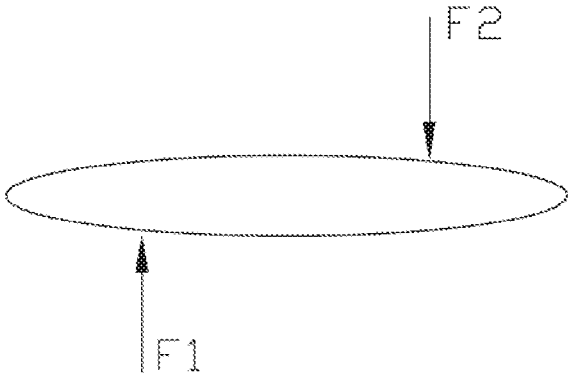
FIG. 6B is a force diagram of a droplet.

Furthermore, the two ultrasonic layers 14 and 15 may control the droplets in a way of "simultaneous drive, separate detection", or in a way of "simultaneous drive, simultaneous detection". In the description of the present disclosure, "simultaneous drive" indicates that at least one of the ultrasonic sensors in the ultrasonic layer 14 and at least one of the ultrasonic sensors in the ultrasonic layer 15 may simultaneously drive a same droplet. As shown in FIG. 6B, at least one of the ultrasonic sensors 141 in the lower first ultrasonic layer 14 applies a force F1 on the droplet, and at least one of the ultrasonic sensors 151 in the upper second ultrasonic layer 15 applies a force F2 on the droplet, so as to drive the droplet to roll clockwise. The way of "simultaneous drive" may provide a greater driving force, so as to move the droplet more easily.

In the description of the present disclosure, "separate detection" indicates that the ultrasonic sensors in the two ultrasonic layers 14 and 15 separately perform detection on the droplets located in different positions. In such condition, positions of the ultrasonic sensors in the two ultrasonic layers 14 and 15 need to be staggered, that is, the plurality of ultrasonic sensors 141 in the first ultrasonic layer 14 between the first substrate 11 and the microcavity 13 are arranged to be opposite and corresponding to intervals each between two adjacent ultrasonic sensors 151 in the second ultrasonic layer 15 between the second substrate 12 and the microcavity 13. In such a case, the ultrasonic sensors 141 and the ultrasonic sensors 151 are completely staggered, so that, under the condition of same sensor size, a higher detection resolution may be acquired, so as to acquire more accurate position information.

In the description of the present disclosure, "simultaneous detection" indicates that the ultrasonic sensors in the two ultrasonic layers 14 and 15 simultaneously perform detection on the droplets. In such condition, the ultrasonic sensors in the two ultrasonic layers 14 and 15 have the same resolution, that is, the plurality of ultrasonic sensors 141 in the first ultrasonic layer 14 between the first substrate 11 and the microcavity 13 are aligned with the ultrasonic sensors 151 in the second ultrasonic layer 15 between the second substrate 12 and the microcavity 13.

It can be known from the above that the droplets may be controlled in the way of "simultaneous drive, separate detection", or "simultaneous drive, simultaneous detection", but the present disclosure is not limited thereto. In practical application, it is feasible to use the ultrasonic sensors in one of the ultrasonic layers (for example, the first ultrasonic layer 14) to drive the liquid, and to use the ultrasonic sensors in the other one of the ultrasonic layers (for example, the second ultrasonic layer 15) to detect the liquid, which may avoid function multiplexing of the ultrasonic sensors, that is, prevent the ultrasonic sensors from having both detection and drive functions, so as to increase drive and detection efficiencies.

In some embodiments of the present disclosure, the plurality of ultrasonic sensors 141 in the first ultrasonic layer 14 between the first substrate 11 and the microcavity 13 are arranged to be opposite and corresponding to intervals each between two adjacent ultrasonic sensors 151 in the second ultrasonic layer 15 between the second substrate 12 and the microcavity 13, so as to completely stagger the ultrasonic sensors 141 and the ultrasonic sensors 151.

It should be noted that, in practical application, it is feasible to arrange the plurality of ultrasonic sensors 141 in the first ultrasonic layer 14 between the first substrate 11 and the microcavity 13 to be opposite to the ultrasonic sensors 151 in the second ultrasonic layer 15 between the second substrate 12 and the microcavity 13, in which case the ultrasonic sensors in the two ultrasonic layers 14 and 15 may be used to simultaneously detect the liquid.

Another technical solution of the present disclosure provides a microfluidic system, including the microfluidic device provided by the embodiments of the present disclosure, and a processing unit for driving the microfluidic device.

According to the embodiments of the present disclosure, the processing unit is configured to determine a moving path of a droplet according to detection parameters and a target position of the droplet, and control corresponding ultrasonic sensors in the microfluidic device to emit ultrasonic waves according to the moving path, so as to drive the droplet to move from a current position to the target position along the moving path.

By using the microfluidic device provided by the present disclosure, the microfluidic system provided by the present disclosure may remove the restriction that the liquid must contain ions and simplify device structures.

Yet another technical solution of the present disclosure provides a driving method of a microfluidic device, including: determining a moving path of a droplet according to detection parameters and a target position of the droplet (step S1): and controlling ultrasonic sensors to emit ultrasonic waves according to the moving path, so as to drive the droplet to move from a current position to the target position along the moving path (step S2).

The detection parameters of the droplet may include relevant parameters which enable acquirement of the moving path of the droplet, such as at least one of shape, size and current position of the droplet.

In the above step S2, at least one ultrasonic sensor is selected to transmit an ultrasonic driving signal to the microcavity according to the moving path of the droplet, so that the specified liquid may be accurately driven.

By providing each ultrasonic sensor used to transmit an ultrasonic driving signal with different delay time, the ultrasonic driving signal transmitted by each ultrasonic sensor may generate a maximum surface sound pressure at a same designated position, so as to move the droplet.

In the above step S1, the ultrasonic sensor may be used to transmit an ultrasonic detection signal to the microcavity, so as to determine the detection parameters of the shape, size and current position of the droplet according to a magnitude of ultrasonic reflectivity of a feedback signal from the microcavity.

Taking the embodiment shown in FIG. 2 as an example, when the ultrasonic waves emitted from the ultrasonic sensors to the microcavity reach a position in the microcavity 13 which is not occupied by a droplet, a reflective interface is an interface between the hydrophobic layer 16 and the filling medium; and when the ultrasonic waves emitted from the ultrasonic sensors to the microcavity reach a position in the microcavity 13 which is occupied by a droplet, a reflective interface is an interface between the hydrophobic layer 16 and the droplet. Since different interfaces have different reflectivities to the ultrasonic waves, the detection parameters of the shape, size and current position of the droplet may be determined according to strength of the feedback signal of the ultrasonic waves.

Figure 7:
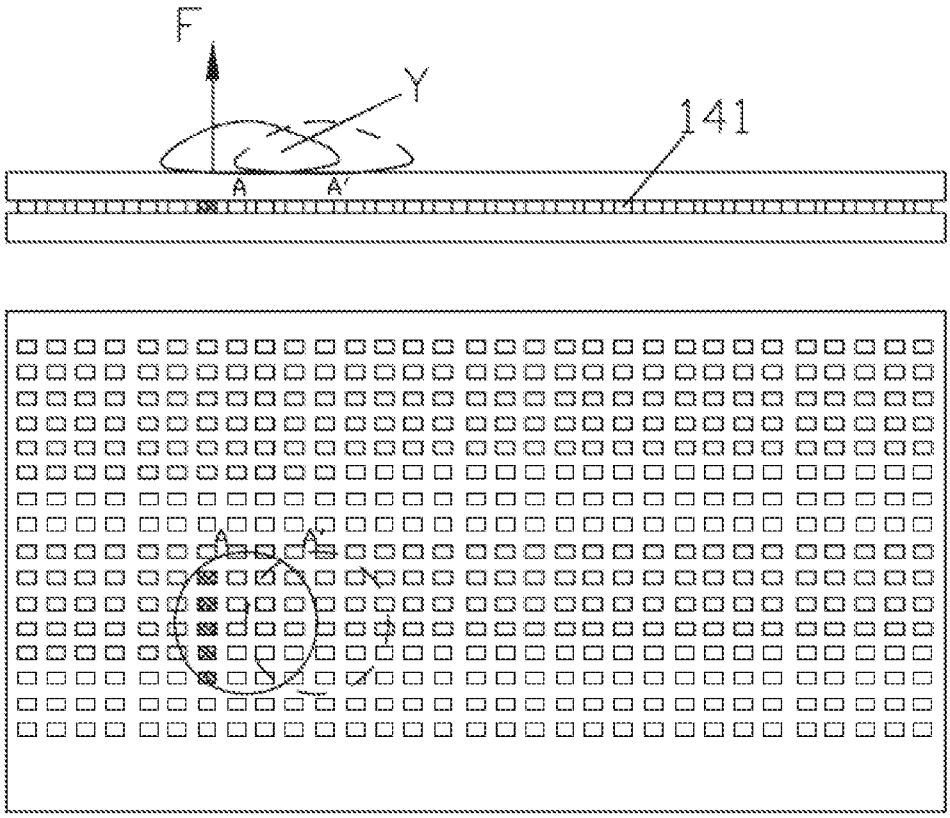
FIG. 7 is a diagram showing a driving principle of an ultrasonic sensor.

FIG. 7 shows a principle of driving a droplet. As shown in FIG. 7, taking the first ultrasonic layer 14 as an example, orthographic projections of the plurality of ultrasonic sensors 141 on the first substrate 11 are arranged in an array, and a projected area of each ultrasonic sensor 141 is significantly smaller than a projected area of a droplet Y. For driving the droplet Y to move from a point A to the right to reach a point A', one or more ultrasonic sensors 141 on the right of the droplet Y may be selected to apply an upward driving force on a left part of the droplet Y, so as to apply a clockwise couple to the droplet Y, thereby droving the droplet Y to roll to the right to reach the point A'. For example, five ultrasonic sensors marked with shadow lines in FIG. 7 may be selected as the ultrasonic sensors for driving the droplet Y to move.

Based on the above driving principle, specific embodiments of the driving method of a microfluidic device will be described in detail. Specifically, as shown in FIG. 8, supposing a current position of a droplet is A, and a target position of the droplet is B, the driving method of a microfluidic device includes steps 101 to 105.

At step 101, detection parameters of the droplet including the shape, size and current position A of the droplet are detected.

Figure 8:
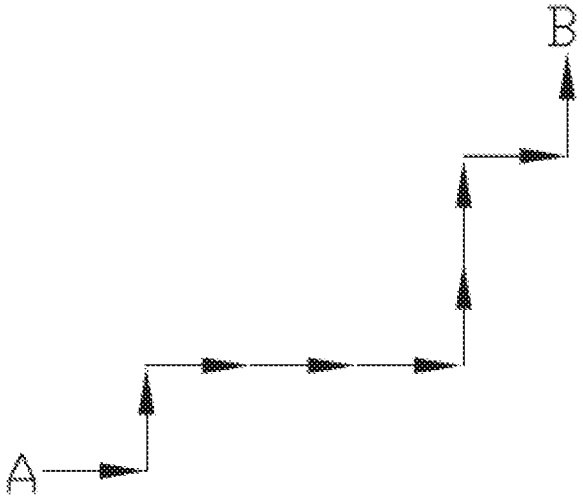
FIG. 8 is a diagram showing a moving path of a droplet.
Figure 9:
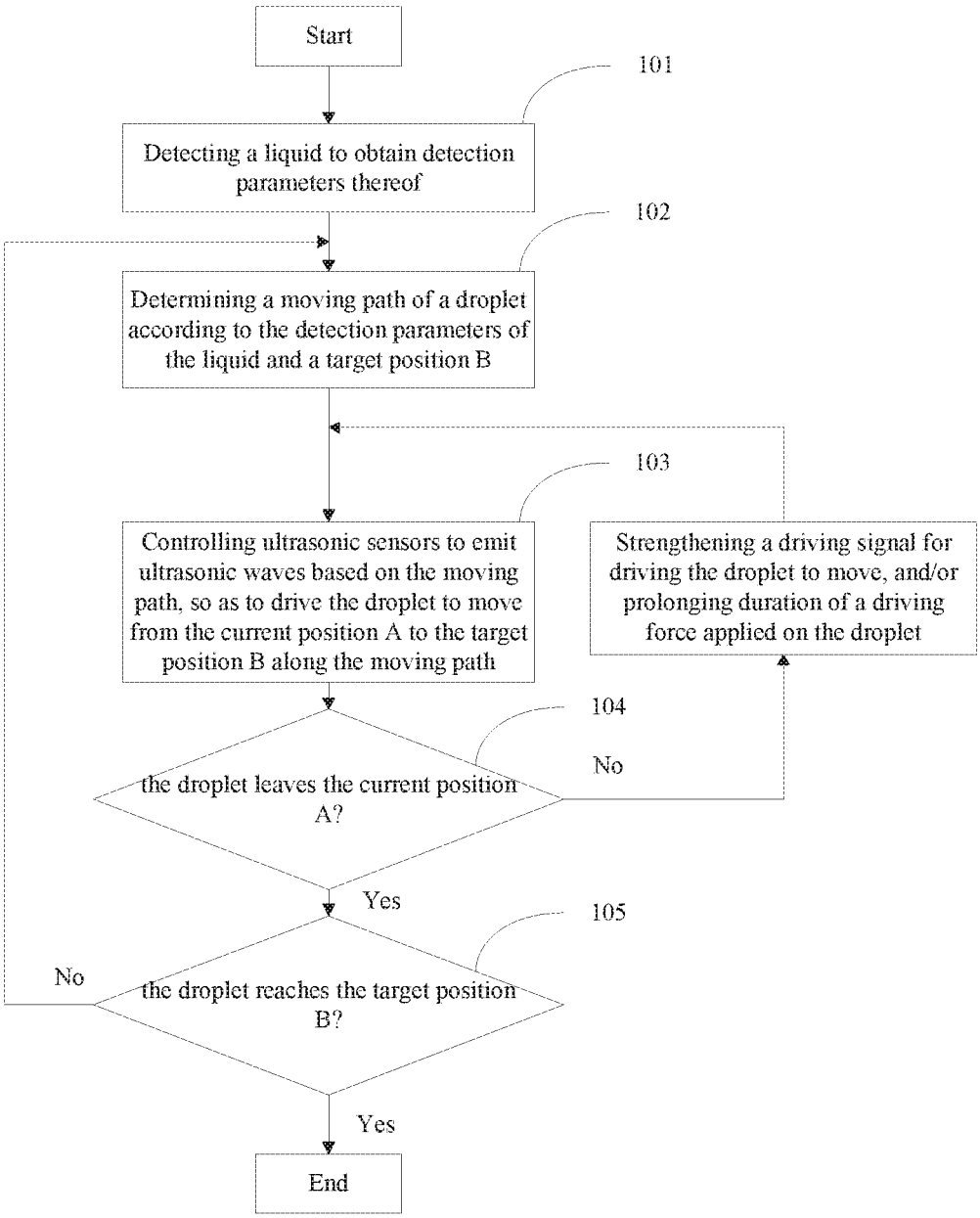
FIG. 9 is a flowchart of a driving method of a microfluidic device according to embodiments of the present disclosure.

At step 102, a moving path of the droplet, for example, as shown by arrows in FIG. 8, is determined according to the detection parameters and the target position B of the droplet.

At step 103, ultrasonic sensors are controlled to emit ultrasonic waves based on the moving path, so as to drive the droplet to move from the current position A to the target position B along the moving path.

At step 104, the droplet is detected to find out whether it leaves the current position A; if yes, step 105 is then performed; if not, step 103 is performed again, with a driving signal for driving the droplet to move being strengthened, and/or duration of a driving force applied on the droplet being prolonged.

At step 105, the droplet is detected to find out whether it reaches the target position B; if yes, a process of the method is finished; if not, the step 102 is performed again.

In sum, by using the ultrasonic sensors in the microfluidic device provided by the present disclosure to emit ultrasonic waves to drive the droplets to move, the driving to method provided by the present disclosure may remove the restriction that the liquid must contain ions and simplify device structures.

It should be understood that the foregoing implementations are merely exemplary implementations adopted for describing the principle of the present disclosure, but the present disclosure is not limited thereto. Those of ordinary skill in the art may make various variations and improvements without departing from the spirit and essence of the present disclosure, and these variations and improvements shall be considered to fall into the protection scope of the present disclosure.

What is claimed is:

1. A microfluidic device, comprising a first substrate and a second substrate disposed opposite to each other, and a microcavity provided between the first and second substrates for accommodating droplets, and further comprising at least one ultrasonic layer provided between the first and second substrates, wherein, the at least one ultrasonic layer includes a plurality of ultrasonic sensors configured to perform at least one of detection operation and driving operation to the droplets accommodated in the microcavity, wherein each ultrasonic sensor comprises a first electrode, a piezoelectric layer and a second electrode which are sequentially disposed along a direction away from the microcavity, wherein the first electrode and/or the second electrode have/has a block structure, and the microfluidic device further comprises:

a transistor layer including a plurality of thin film transistors and an insulation layer, wherein the thin film transistors are positioned on a side of the first substrate and/or the second substrate close to the microcavity, and the plurality of thin film transistors are provided to be corresponding to the plurality of ultrasonic sensors, the insulation layer is provided on the first substrate and/or the second substrate and covers the plurality of thin film transistors, wherein, the second electrode is provided on a side of the insulation layer close to the microcavity, and is electrically connected with the thin film transistor through a via.

2. The microfluidic device of claim 1, wherein, at least one ultrasonic layer is provided between the first substrate and the microcavity, and/or at least one ultrasonic layer is provided between the second substrate and the microcavity.

3. The microfluidic device of claim 2, wherein, two ultrasonic layers are provided between the first substrate and the microcavity, or two ultrasonic layers are provided between the second substrate and the microcavity, an orthographic projection of each ultrasonic sensor in one of the two ultrasonic layers on the first substrate does not completely overlap an orthographic projection of each ultrasonic sensor in the other one of the two ultrasonic layers on the first substrate, and each ultrasonic sensor in one of the two ultrasonic layers is configured to detect the droplets accommodated in the microcavity, and each ultrasonic sensor in the other one of the two ultrasonic layers is configured to drive the droplets accommodated in the microcavity.

4. The microfluidic device of claim 3, wherein the ultrasonic sensors in the two ultrasonic layers differ in volume.

5. The microfluidic device of claim 2, wherein, one ultrasonic layer is provided between the first substrate and the microcavity, and one ultrasonic layer is provided between the second substrate and the microcavity, wherein, an arrangement density of the plurality of ultrasonic sensors in the ultrasonic layer between the first substrate and the microcavity is different from that of the plurality of ultrasonic sensors in the ultrasonic layer between the second substrate and the microcavity.

6. The microfluidic device of claim 2, wherein the plurality of ultrasonic sensors in the ultrasonic layer between the first substrate and the microcavity are arranged to be corresponding to intervals each between two adjacent ultrasonic sensors in the ultrasonic layer between the second substrate and the microcavity.

7. The microfluidic device of claim 1, further comprising:

two hydrophobic layers disposed opposite to each other and between the first and second substrates; and spacers provided between the two hydrophobic layers, wherein, the microcavity is composed of the two hydrophobic layers and the spacers, and the at least one ultrasonic layer is positioned on a side of the hydrophobic layers away from the microcavity.

8. The microfluidic device of claim 7, wherein the microcavity is provided therein with a filling medium having an acoustic impedance coefficient greater than or equal to that of the hydrophobic layers.

9. A microfluidic system, comprising the microfluidic device of claim 1, and a processing unit, wherein the processing unit is configured to drive the microfluidic device.

10. The microfluidic system of claim 9, wherein, in the microfluidic device, at least one ultrasonic layer is provided between the first substrate and the microcavity, and/or at least one ultrasonic layer is provided between the second substrate and the microcavity.

11. The microfluidic system of claim 10, wherein, in the microfluidic device, two ultrasonic layers are provided between the first substrate and the microcavity, or two ultrasonic layers are provided between the second substrate and the microcavity, an orthographic projection of each ultrasonic sensor in one of the two ultrasonic layers on the first substrate does not completely overlap an orthographic projection of each ultrasonic sensor in the other one of the two ultrasonic layers on the first substrate, and each ultrasonic sensor in one of the two ultrasonic layers is configured to detect the droplets accommodated in the microcavity, and each ultrasonic sensor in the other one of the two ultrasonic layers is configured to drive the droplets accommodated in the microcavity.

12. The microfluidic system of claim 10, wherein, in the microfluidic device, one ultrasonic layer is provided between the first substrate and the microcavity, and one ultrasonic layer is provided between the second substrate and the microcavity, wherein, an arrangement density of the plurality of ultrasonic sensors in the ultrasonic layer between the first substrate and the microcavity is different from that of the plurality of ultrasonic sensors in the ultrasonic layer between the second substrate and the microcavity.

13. The microfluidic system of claim 10, wherein, in the microfluidic device, the plurality of ultrasonic sensors in the ultrasonic layer between the first substrate and the microcavity are arranged to be corresponding to intervals each between two adjacent ultrasonic sensors in the ultrasonic layer between the second substrate and the microcavity.

14. The microfluidic system of claim 9, wherein, the microfluidic device further comprises:

two hydrophobic layers disposed opposite to each other and between the first and second substrates; and spacers provided between the two hydrophobic layers, wherein, the microcavity is composed of the two hydrophobic layers and the spacers, and the at least one ultrasonic layer is positioned on a side of the hydrophobic layers away from the microcavity.

15. The microfluidic system of claim 9, wherein, in the microfluidic device, each ultrasonic sensor comprises a first electrode, a piezoelectric layer and a second electrode which are sequentially disposed along a direction away from the microcavity, wherein the first electrode and/or the second electrode have/has a block structure, and the microfluidic device further comprises:

a transistor layer including a plurality of thin film transistors and an insulation layer, wherein the thin film transistors are positioned on a side of the first substrate and/or the second substrate close to the microcavity, and the plurality of thin film transistors are provided to be corresponding to the plurality of ultrasonic sensors, the insulation layer is provided on the first substrate and/or the second substrate and covers the plurality of thin film transistors, wherein, the second electrode is provided on a side of the insulation layer close to the microcavity, and is electrically connected with the thin film transistor through a via.

* * * * *